US009227100B2

(12) United States Patent
Johnson

(10) Patent No.: US 9,227,100 B2
(45) Date of Patent: Jan. 5, 2016

(54) PORTABLE PHYSICAL THERAPY EXERCISE SUPPORT STAND

(71) Applicant: Tammy Johnson, Tuscumbia, AL (US)

(72) Inventor: Tammy Johnson, Tuscumbia, AL (US)

( * ) Notice: Subject to any disclaimer, the term of this patent is extended or adjusted under 35 U.S.C. 154(b) by 45 days.

(21) Appl. No.: 13/664,537

(22) Filed: Oct. 31, 2012

(65) Prior Publication Data

US 2013/0109547 A1 May 2, 2013

Related U.S. Application Data

(60) Provisional application No. 61/628,498, filed on Nov. 1, 2011.

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 21/00*** | (2006.01) |
| ***A63B 23/08*** | (2006.01) |
| ***A63B 23/10*** | (2006.01) |

(52) U.S. Cl.

CPC ..... *A63B 21/0414* (2013.01); *A63B 21/0555* (2013.01); *A63B 21/0557* (2013.01); *A63B 21/143* (2013.01); *A63B 21/1465* (2013.01); *A63B 23/08* (2013.01); *A63B 23/10* (2013.01); *A63B 2210/50* (2013.01)

(58) Field of Classification Search

CPC ..... A63B 21/00; A63B 21/0414; A63B 21/0555; A63B 21/055; A63B 21/0557; A63B 21/1465; A63B 23/04; A63B 23/10; A63B 23/08

USPC ..... 482/92, 121–126, 129; 124/16, 17, 20.1

See application file for complete search history.

(56) References Cited

U.S. PATENT DOCUMENTS

| | | | | | |
|---|---|---|---|---|---|
| 224,049 | A | * | 2/1880 | Smith | 124/20.1 |
| 1,561,979 | A | * | 11/1925 | Gore | 482/130 |
| 2,706,631 | A | * | 4/1955 | Holmes | A63K 3/043 248/170 |
| 2,919,134 | A | * | 12/1959 | Zuro | 482/129 |
| 3,299,564 | A | * | 1/1967 | Quercetti | 446/231 |
| D256,822 | S | * | 9/1980 | Ozzimo | D21/677 |
| 4,241,914 | A | * | 12/1980 | Bushnell | A63B 1/00 482/130 |
| 4,873,964 | A | * | 10/1989 | Bonoan | A63B 65/12 124/20.1 |
| 5,005,828 | A | * | 4/1991 | Sauerbrey | A63B 5/02 446/901 |
| 5,279,532 | A | * | 1/1994 | Chen | A63B 21/0552 482/121 |
| 5,318,495 | A | * | 6/1994 | Malynowsky | 482/129 |
| 5,398,665 | A | * | 3/1995 | Carlson | 124/17 |
| 5,593,374 | A | * | 1/1997 | Gvoich | 482/123 |
| 5,657,984 | A | * | 8/1997 | Leo | 124/20.1 |
| 5,873,798 | A | * | 2/1999 | Bostick | A63B 69/0084 473/426 |

(Continued)

OTHER PUBLICATIONS

"Watermelon of Pain." Sep. 9, 2010. <http://gif-explode.com/?explode=http://www.geekologie.com/2010/09/08/watermelon-of-pain.gif>.*

*Primary Examiner* — Stephen Crow
*Assistant Examiner* — Garrett Atkinson
(74) *Attorney, Agent, or Firm* — Larnier Ford Shaver & Payne, P.C.; Ann I. Dennen

(57) ABSTRACT

A portable exercise support stand includes a base from which extend first and second vertical support members, each having upward ends and a resilient, elastic member having ends attached to the upward ends of the first and second support members.

1 Claim, 3 Drawing Sheets

(56) References Cited

U.S. PATENT DOCUMENTS 7,033,290 B1 * 4/2006 Coldren ..... A63B 69/0002 473/422
7,635,319 B2 * 12/2009 Dieter ..... A63B 5/02 482/129
8,021,273 B2 * 9/2011 Kopp ..... A63B 1/00 297/281
003/0073504 A1 * 4/2003 Ettenhofer ..... A63B 69/04 472/104
2007/0144505 A1 * 6/2007 McCallister et al. ..... 124/20.1
2009/0143200 A1 * 6/2009 Hawkersmith ..... A63B 69/34 482/87
2010/0204014 A1 * 8/2010 Hoffman ..... 482/8
2014/0274587 A1 * 9/2014 Ruggiero ..... A63B 69/206 482/87

* cited by examiner

PORTABLE PHYSICAL THERAPY EXERCISE SUPPORT STAND

BACKGROUND

1. Field

The present invention relates generally to physical therapy exercise equipment, and particularly to portable physical therapy exercise equipment.

2. Description of the Problem and Related Art

Rehabilitation of musculoskeletal injuries often entails exercising the affected appendage by moving a joint against a resistive load. If performed in the home, often such exercises comprise using an elastic band having one end secured a stable object, e.g., a piece of furniture, or a door knob. But, while this is convenient and inexpensive, such rudimentary arrangements may not provide sufficient resistive load which otherwise may be provided by more complicated machinery.

Further, physical therapists sometimes conduct rehabilitative training sessions in a patient's home. However, other than the aforementioned elastic bands, porting equipment may be cumbersome, difficult or impractical.

Disclosed herein is a portable support stand for at-home physical therapy to provide a support for elastic bands.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1:
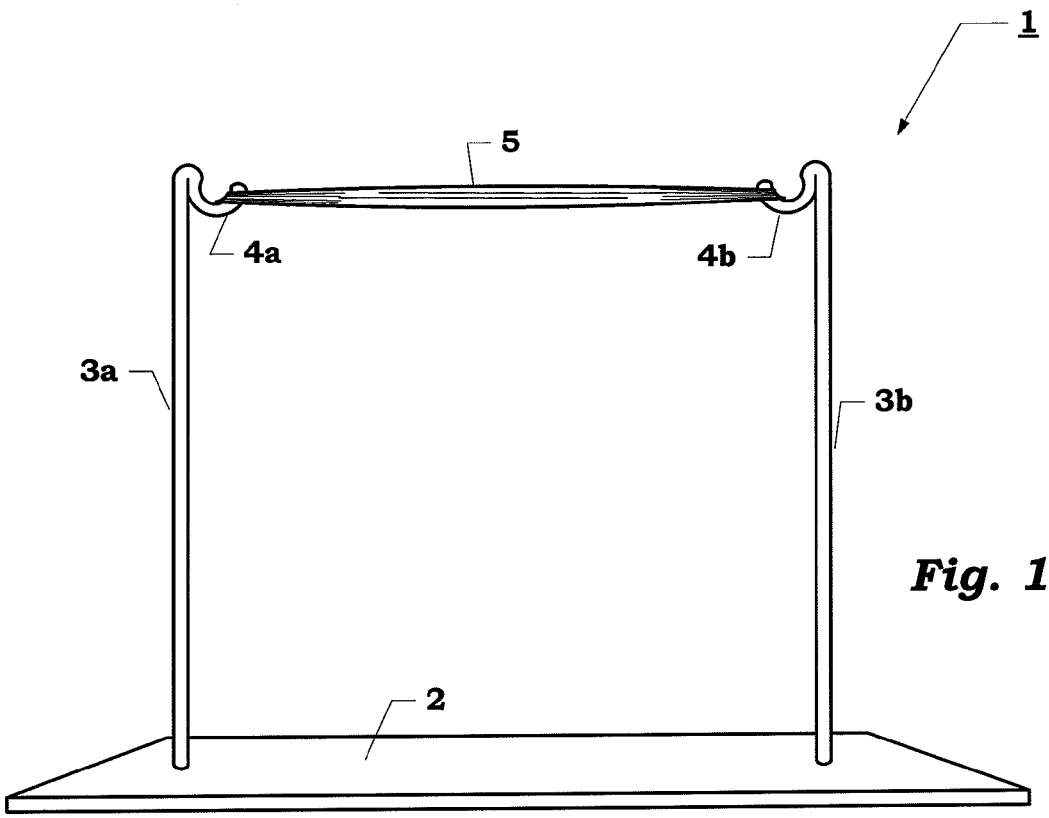
FIG. 1 is a side view of an exemplary physical therapy support stand.
Figure 1A:
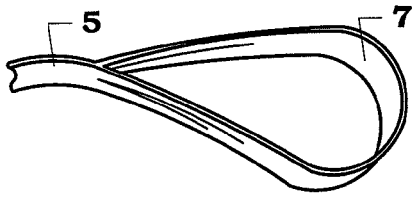
FIG. 1A shows an end of a resilient, elastic member for use with the exemplary support stand of FIG. 1.

The various embodiments of the present invention and their advantages are best understood by referring to FIGS. 1 through 6 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the description herein indicate the scope of the invention.

An exemplary exercise support stand 1 comprises a base 2 having an upper planar surface from which extend opposing upright support members 3*a*, 3*b*. A resilient, elastic member 5 is stretched between the upright support members 3*a*, 3*b*. The support members 3*a*, 3*b* are spaced apart in order to support the maintenance of tension on a resilient, elastic tension member 5 having opposite ends hooked each support member 3*a*, 3*b*. Optionally, the support members 3*a*, 3*b* may comprise opposing hooks 4*a*, 4*b*, to serve as attachment points for the elastic member 5 ends. In addition, elastic member 5 may be formed with looped ends 7 to permit to receive the hooks and attach the elastic member ends to the upright support members 3*a*, 3*b*. In the alternative, the ends of the elastic member 5 may simply be looped around the support members 3*a*, 3*b*, or the hooks 4*a*, 4*b*, and knotted 8*a*, 8*b*.

The base is dimensioned to provide stability to the upright support members during use, but such that the length and width thereof may be easily lifted and carried by one person. Lengths of between about 1½ to about 3 feet, with widths of between about 1 to about 2 feet, are preferred. Additionally, the stand should be formed of a rigid, lightweight material, and should preferably weigh between about 15 lbs to about 25 lbs.

Figure 2:
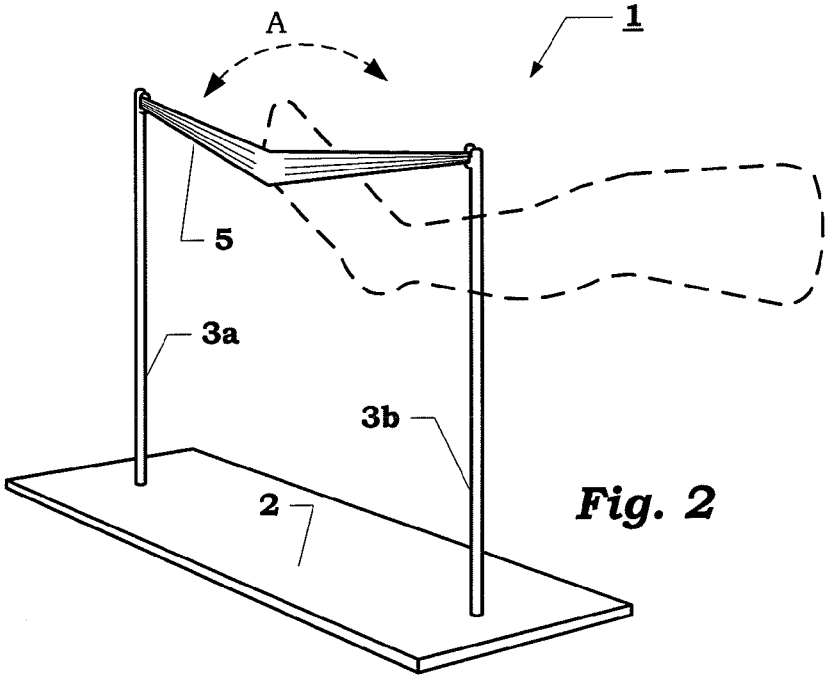
FIG. 2 shows the exemplary support stand of FIG. 1 in use.

As shown in FIG. 2, the elastic member 5, maintained in tension by attachment to the upright supports, provides resistance against deformation when a patient presses against the elastic member 5 with an appendage. In this way, muscles associated with moving the affected appendage are exercised against a load. As will be appreciated by those skilled in the relevant arts, this configuration may be effective for bi-directional movement in the vertical plane of motion, indicated by reference arrow A, working both flexion and extension.

Figure 3:
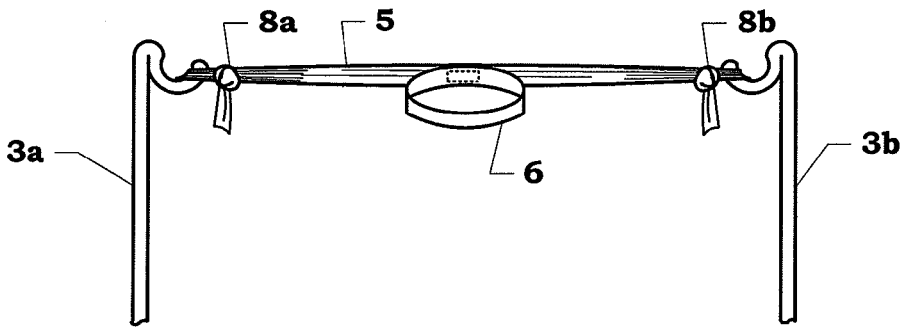
FIG. 3 illustrates a second exemplary embodiment of the resilient member for use with exemplary support stand.
Figure 4:
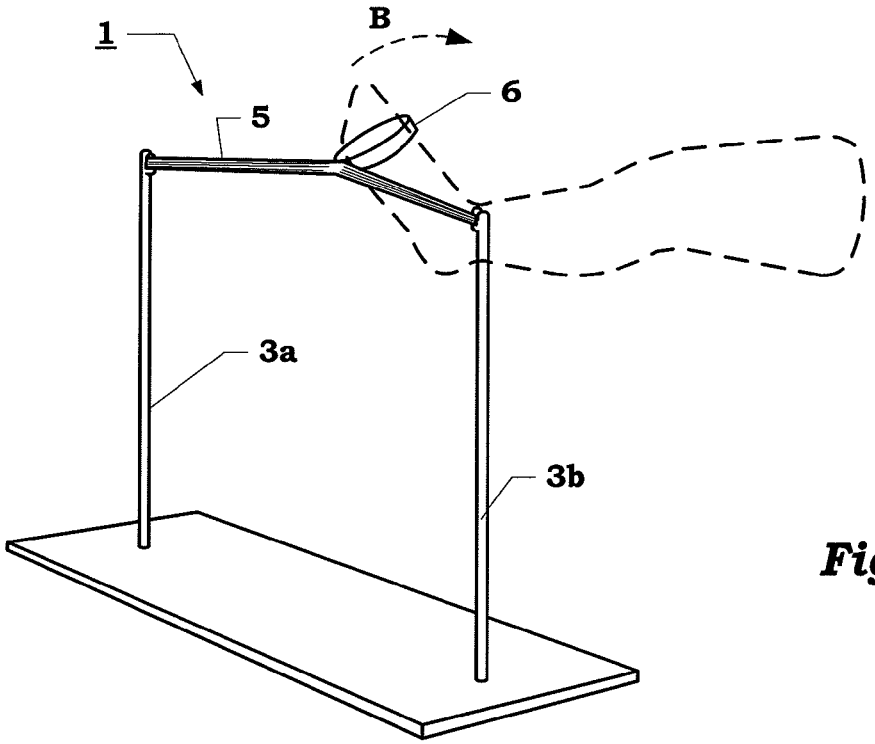
FIG. 4 shows the exemplary support stand in use with the resilient member of FIG. 3.
Figure 5:
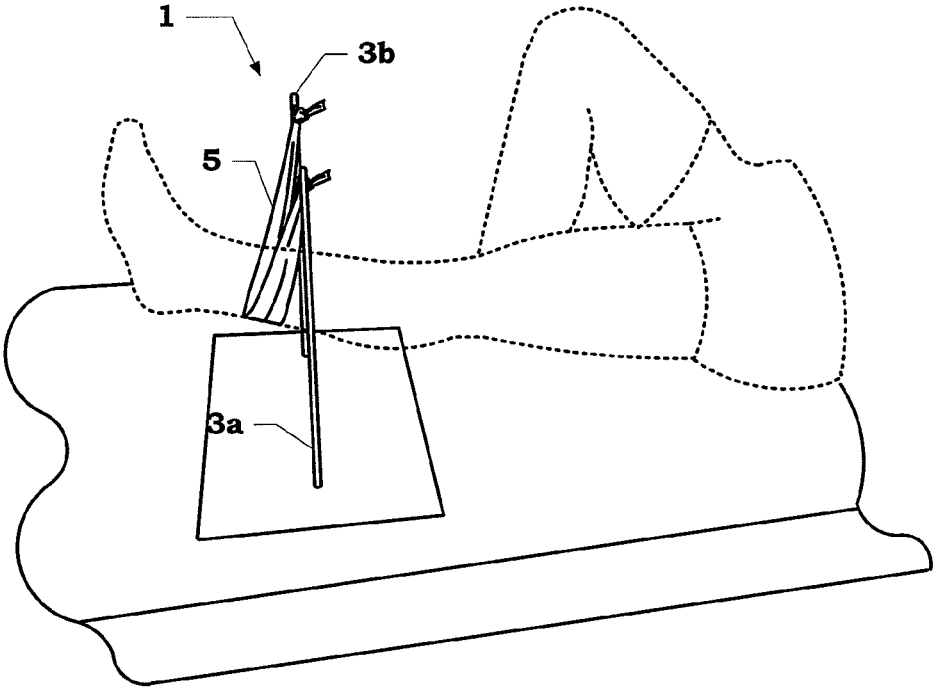
FIG. 5 shows another possible therapeutic use of the exemplary support stand.
Figure 6:
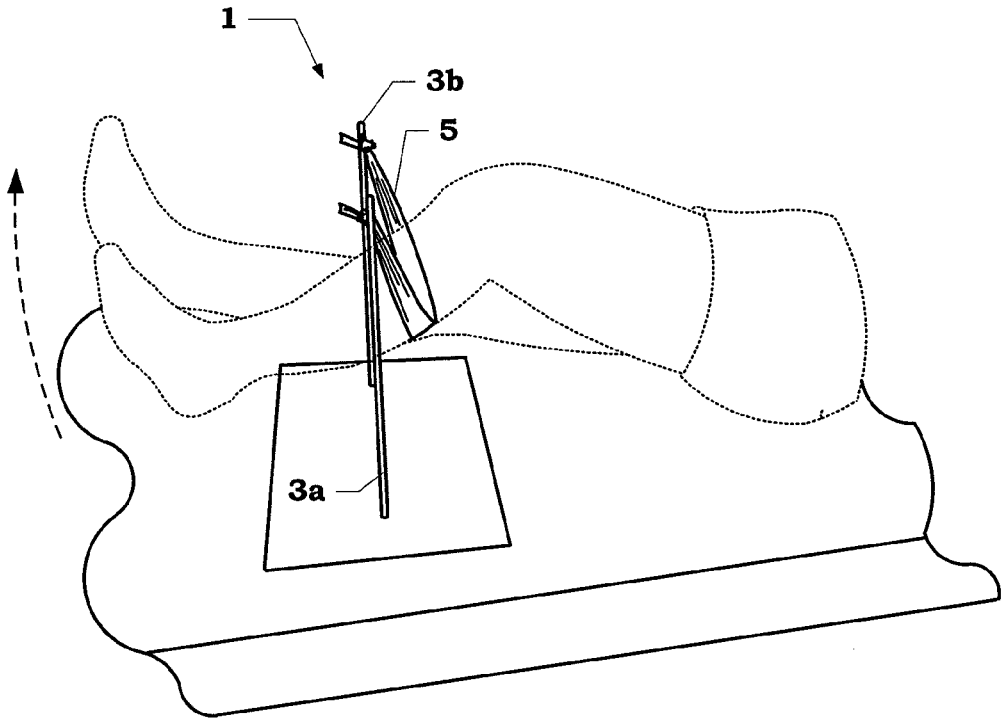
FIG. 6 shows another possible therapeutic use of the exemplary support stand.

A further embodiment shown in FIGS. 3 & 4 includes a loop 6 located about the middle of the elastic member 5. An appendage may be inserted into the loop 6 to allow pulling against the elastic member 5. FIGS. 5 and 6 illustrate another possible therapeutic use of the support stand disclosed herein, namely, used to maintain elevation of a limb for patients that lack the strength to maintain such elevation.

As described above and shown in the associated drawings, the present invention comprises an apparatus for a physical therapy exercise support stand. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A portable physical exercise support stand for therapeutic exercising of muscles of a physical therapy patient's limb consisting of:

a base member having a solid, planar top surface having a length between about 1.5 feet to about three feet and width between about one foot to about two feet and comprising a rigid, lightweight material and weighing up to about 25 lbs;

first and second upright support members mounted in said top surface of said base and each having upward ends extending vertically upward from said top surface; and a single elongated unitary resilient member, being resilient throughout, having a first end and a second end, said first end directly attached to said upper end of said first upright support member, said single elongated unitary resilient member stretched from said first upright support member directly to said second upright support member, said second end directly attached to said upward end of said second upright support member, wherein a loop is disposed midway along said resilient member and dimensioned to receive said patient's limb inserted therein; and wherein said support members are disposed in a spaced-apart relationship in order to maintain tension of said resilient member and allow a therapy patient's limb to be placed upon said resilient member.

* * * * *